US006802091B1

(12) United States Patent
Harris

(10) Patent No.: US 6,802,091 B1
(45) Date of Patent: Oct. 12, 2004

(54) PATIENT MOVING BED ASSEMBLY

(76) Inventor: Lenon Harris, 3 Holly Thorn Ct., Columbia, SC (US) 29229

( * ) Notice: Subject to any disclaimer, the term of this patent is extended or adjusted under 35 U.S.C. 154(b) by 0 days.

(21) Appl. No.: 10/388,909

(22) Filed: Mar. 14, 2003

(51) Int. Cl.[7] ..... A61G 7/10
(52) U.S. Cl. ..... 5/81.1 R; 5/81.1 HS
(58) Field of Search ..... 5/81.1 R, 81.1 HS, 5/86.1

(56) References Cited

U.S. PATENT DOCUMENTS 3,786,523 A * 1/1974 Sele ..... 5/87.1
3,854,152 A 12/1974 Chez
3,967,328 A 7/1976 Cox
4,259,756 A * 4/1981 Pace ..... 5/81.1 HS
4,274,168 A * 6/1981 Depowski ..... 5/81.1 HS
D272,395 S 1/1984 Sonder et al.
4,860,394 A 8/1989 Benessis et al.
4,873,732 A * 10/1989 Perez ..... 5/81.1 HS
4,914,769 A 4/1990 Kume et al.
5,048,133 A 9/1991 Iura et al.

* cited by examiner

*Primary Examiner*—Teri Pham Luu
*Assistant Examiner*—Frederick Conley

(57) ABSTRACT

A patient moving bed assembly for transferring a patient from a primary bed to a secondary support such as a gurney includes a frame, a mattress, a mattress support panel having tracks, rollers engaged to the tracks, and a motor to move the rollers in a desired direction to move the mattress laterally.

9 Claims, 3 Drawing Sheets

PATIENT MOVING BED ASSEMBLY

BACKGROUND OF THE INVENTION

1. Field of the Invention

The present invention relates to beds and more particularly pertains to a new patient moving bed assembly for transferring a patient from a primary bed to a secondary support such as a gurney.

2. Description of the Prior Art

The use of beds is known in the prior art. More specifically, beds heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,967,628; 4,914,769; 3,854,152; 4,860,394; 5,048,133; and U.S. Pat No. Des. 272,395.

While these devices fulfill their respective, particular objectives and requirements, the aforementioned patents do not disclose a new patient moving bed assembly. The inventive device includes a frame, a mattress, a mattress support panel having tracks, rollers engaged to the tracks, and a motor to move the rollers in a desired direction to move the mattress laterally.

In these respects, the patient moving bed assembly according to the present invention substantially departs from the conventional concepts and designs of the prior art, and in so doing provides an apparatus primarily developed for the purpose of for transferring a patient from a primary bed to a secondary support such as a gurney.

SUMMARY OF THE INVENTION

In view of the foregoing disadvantages inherent in the known types of beds now present in the prior art, the present invention provides a new patient moving bed assembly construction wherein the same can be utilized for transferring a patient from a primary bed to a secondary support such as a gurney.

The general purpose of the present invention, which will be described subsequently in greater detail, is to provide a new patient moving bed assembly apparatus and method which has many of the advantages of the beds mentioned heretofore and many novel features that result in a new patient moving bed assembly which is not anticipated, rendered obvious, suggested, or even implied by any of the prior art beds, either alone or in any combination thereof.

To attain this, the present invention generally comprises a frame, a mattress, a mattress support panel having tracks, rollers engaged to the tracks, and a motor to move the rollers in a desired direction to move the mattress laterally.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new patient moving bed assembly apparatus and method which has many of the advantages of the beds mentioned heretofore and many novel features that result in a new patient moving bed assembly which is not anticipated, rendered obvious, suggested, or even implied by any of the prior art beds, either alone or in any combination thereof.

It is another object of the present invention to provide a new patient moving bed assembly which may be easily and efficiently manufactured and marketed.

It is a further object of the present invention to provide a new patient moving bed assembly which is of a durable and reliable construction.

An even further object of the present invention is to provide a new patient moving bed assembly which is susceptible of a low cost of manufacture with regard to both materials and labor, and which accordingly is then susceptible of low prices of sale to the consuming public, thereby making such patient moving bed assembly economically available to the buying public.

Still yet another object of the present invention is to provide a new patient moving bed assembly which provides in the apparatuses and methods of the prior art some of the advantages thereof, while simultaneously overcoming some of the disadvantages normally associated therewith.

Still another object of the present invention is to provide a new patient moving bed assembly for transferring a patient from a primary bed to a secondary support such as a gurney.

Still yet another object of the present invention is to provide a new patient moving bed assembly that permits movement of a person in a prone position without requiring multiple persons to lift the person.

Even still another object of the present invention is to provide a new patient moving bed assembly that moves a person to a mobile support without having to move the person from the surface that is directly supporting the person.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
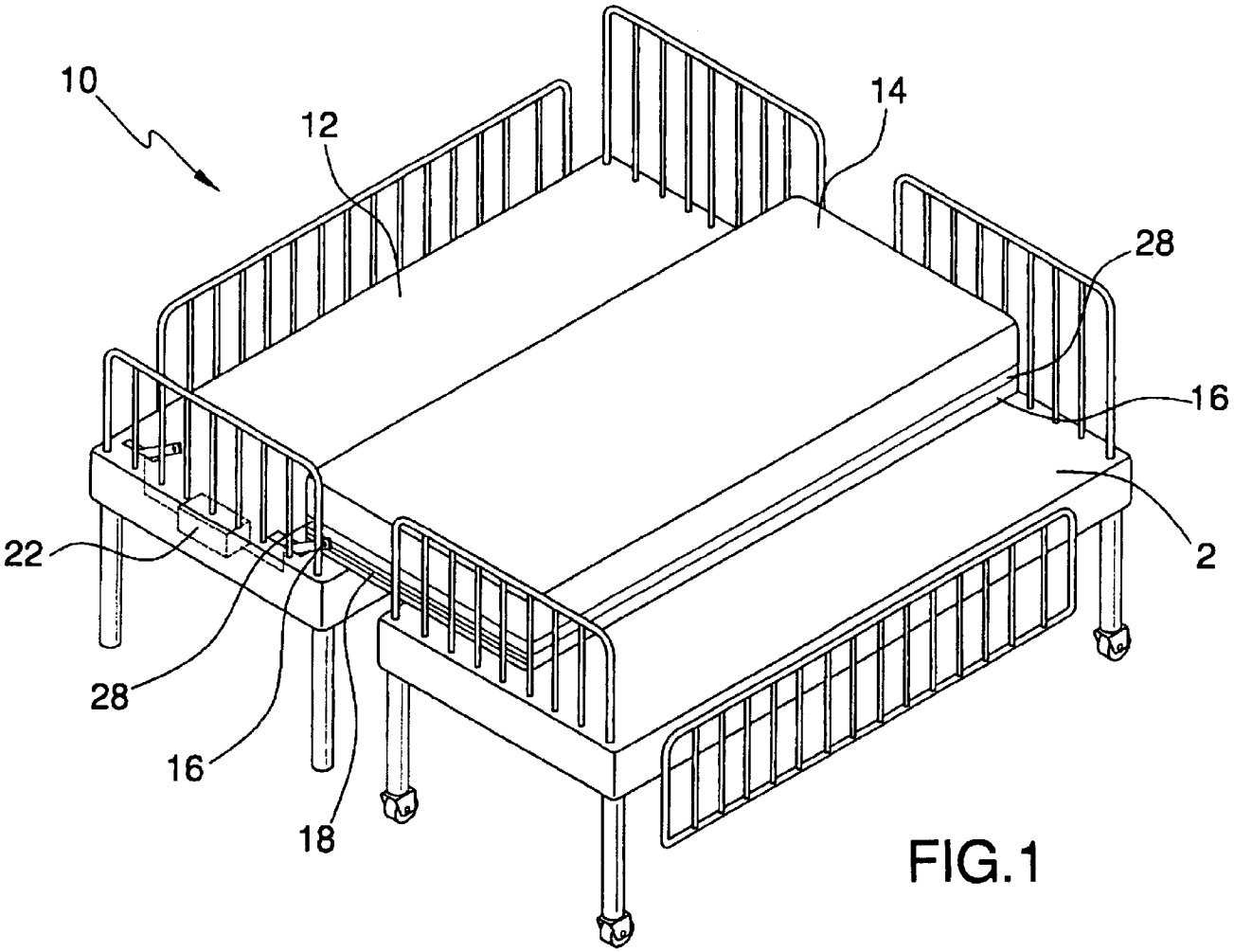
FIG. 1 is a perspective view of a new patient moving bed assembly according to the present invention.
Figure 2:
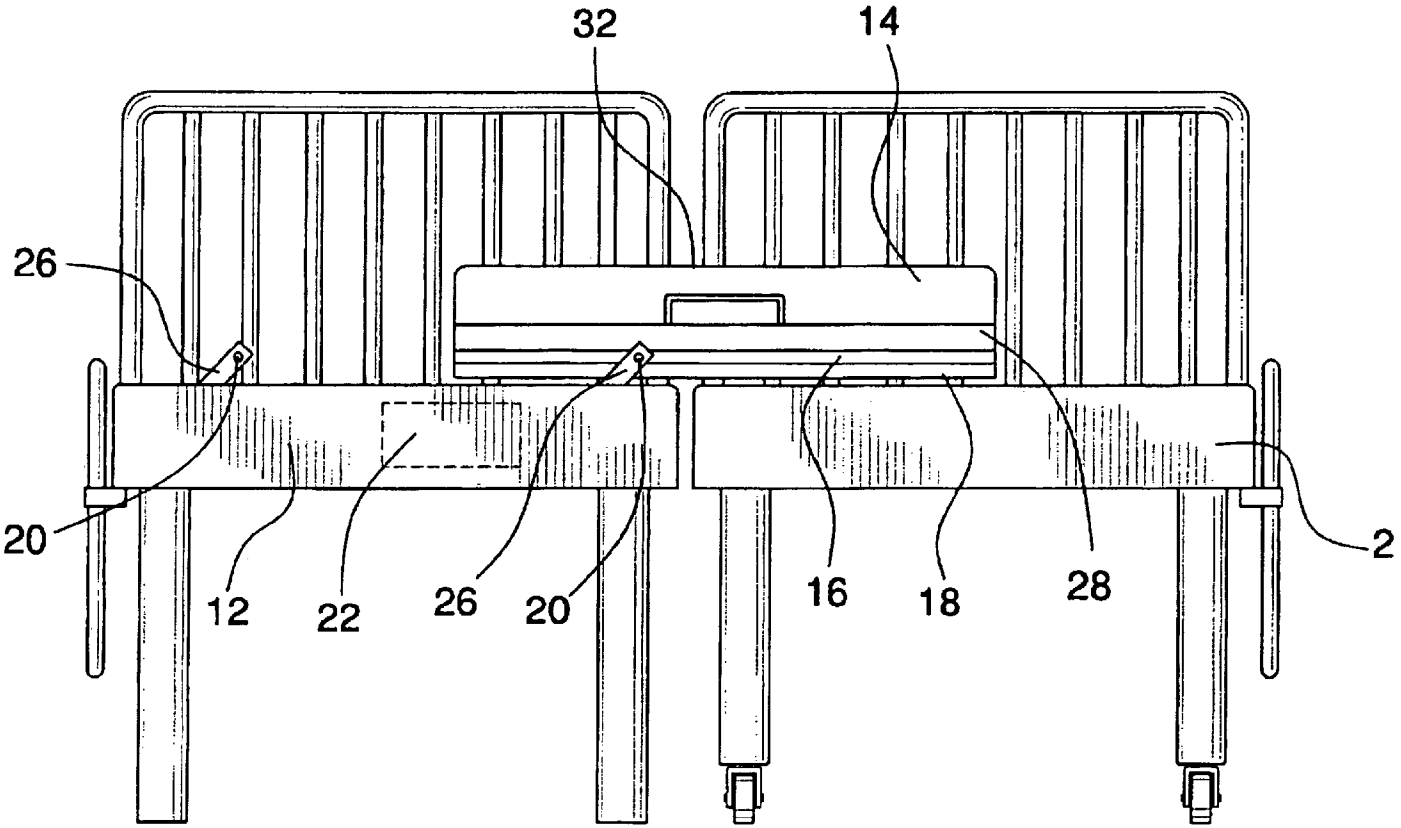
FIG. 2 is an end view of the present invention.
Figure 3:
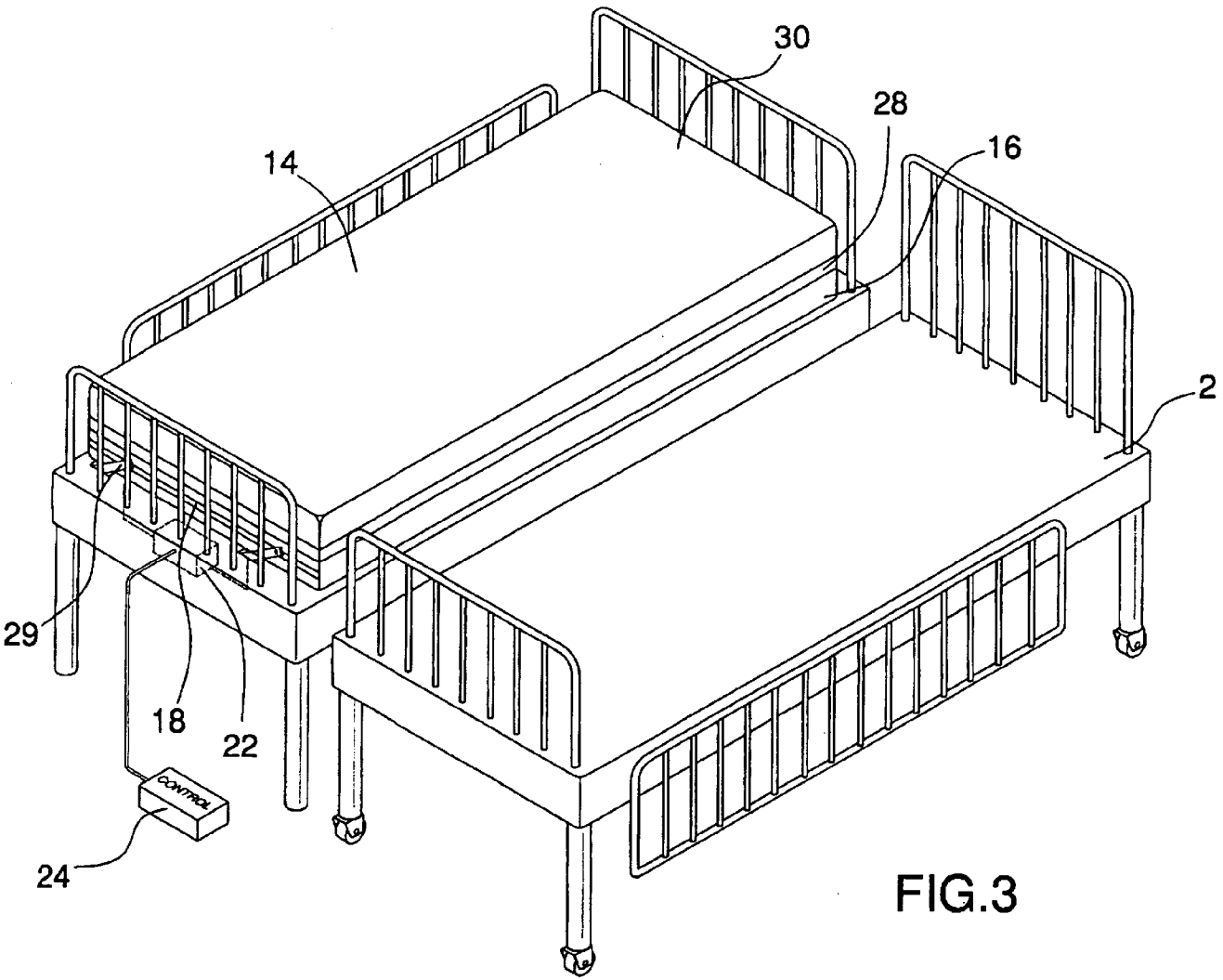
FIG. 3 is a perspective view of the present invention.

With reference now to the drawings, and in particular to FIGS. 1 through 3 thereof, a new patient moving bed assembly embodying the principles and concepts of the present invention and generally designated by the reference numeral 10 will be described.

As best illustrated in FIGS. 1 through 3, the patient moving bed assembly 10 generally comprises a frame 12, a mattress 14, a mattress support panel 16 supported by the frame 12 and coupled to the mattress 14, a pair of tracks 18, and rollers 20.

Each track 18 extends along a respective end of the mattress support panel 16. The rollers 20 are coupled to the frame 12 and engage the tracks for facilitating lateral movement of the mattress 14.

A motor 22 is coupled to the frame 12 by conventional means. The motor 22 is operationally coupled to the rollers 20 by known techniques for moving the rollers 20 to laterally move the mattress 14 in a desired direction. A control mechanism 24 is coupled to the motor 22 for selectively activating the motor 22 and selecting the direction of rotation of the rollers 20.

A plurality of rollers 20 are coupled to pivoting support arms 26 extending from the frame 12 for facilitating engagement of the plurality of rollers 20 to the tracks 18 when the mattress 14 is positioned laterally from the frame 12. Thus, the rollers may be moved to the side of the frame 12 to engage the tracks 18 and the motor 22 activated to bring the mattress back into position being supported by the frame 12. Each of the rollers 20 is disengageable from the tracks 18 to permit release of the mattress 14 from the frame 12 such that the mattress 14 is supported on a gurney 2 positioned adjacent to the frame 12.

The tracks 18 and rollers 20 are positioned such that the mattress 14 remains positioned in a substantially horizontal plane as the mattress 14 is moved laterally.

A bed tilting means 28 is coupled between the mattress 14 and the mattress support panel 16 for selectively raising a foot portion 30 and a head portion 32 of the mattress as is commonly done with hospital beds.

The mattress support panel 16 is positioned to remain in a horizontal position when the head and foot portions 32 and 30 of the mattress 14 are raised.

The rollers 20 are engageable to the tracks 18 when the mattress support panel 16 is supported on a gurney 2 positioned adjacent to the frame 12 for facilitating lateral movement of the mattress support panel 16 to return the mattress 14 to the frame 12. The rollers 20 are then disengageable from the tracks 18 such that the support mattress is supported directly on the frame 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bed assembly comprising:

a frame;

a mattress;

a mattress support panel, said frame supporting said mattress support panel, said mattress being coupled to said mattress support panel;

a pair of tracks, each track extending along a respective end of said mattress support panel;

rollers coupled to said frame and engaging said tracks for facilitating lateral movement of said mattress;

a bed tilting means coupled between said mattress and said mattress support panel for selectively raising a foot portion and a head portion of said mattress; and wherein said mattress support panel is positioned to remain in a horizontal position when said head and foot portions of said mattress are raised.

2. The bed assembly of claim 1, further comprising:

a motor coupled to said frame, said motor being operationally coupled to said rollers for moving said rollers to laterally move said mattress.

3. The bed assembly of claim 2, further comprising:

a control mechanism coupled to said motor for selectively activating said motor.

4. The bed assembly of claim 2, further comprising:

a plurality of said rollers being coupled to pivoting support arms extending from said frame for facilitating engagement of said plurality of rollers to said tracks when said mattress is positioned laterally from said frame.

5. The bed assembly of claim 4 wherein said rollers are engageable to said tracks when said mattress support panel is supported on a gurney positioned adjacent to said frame for facilitating lateral movement of said mattress support panel to return said mattress to said frame.

6. The bed assembly of claim 1 wherein said tracks and rollers are positioned such that said mattress remains positioned in a substantially horizontal plane as said mattress is moved laterally.

7. The bed assembly of claim 1 wherein each of said rollers is disengageable from said tracks to permit release of said mattress from said frame such that said mattress is supported on a gurney positioned adjacent to said frame.

8. The bed assembly of claim 1 wherein said rollers are selectively disengageable from said tracks such that said support mattress is supported directly on said frame.

9. A bed assembly comprising:

a frame;

a mattress;

a mattress support panel, said frame supporting said mattress support panel, said mattress being coupled to said mattress support panel;

a pair of tracks, each track extending along a respective end of said mattress support panel;

rollers coupled to said frame and engaging said tracks for facilitating lateral movement of said mattress;

a motor coupled to said frame, said motor being operationally coupled to said rollers for moving said rollers to laterally move said mattress;

a control mechanism coupled to said motor for selectively activating said motor;

a plurality of said rollers being coupled to pivoting support arms extending from said frame for facilitating engagement of said plurality of rollers to said tracks when said mattress is positioned laterally from said frame;

wherein each of said rollers is disengageable from said tracks to permit release of said mattress from said frame such that said mattress is supported on a gurney positioned adjacent to said frame;

wherein said tracks and rollers are positioned such that said mattress remains positioned in a substantially horizontal plane as said mattress is moved laterally;

a bed tilting means coupled between said mattress and said mattress support panel for selectively raising a foot portion and a head portion of said mattress;

wherein said mattress support panel is positioned to remain in a horizontal position when said head and foot portions of said mattress are raised;

wherein said rollers are engageable to said tracks when said mattress support panel is supported on a gurney positioned adjacent to said frame for facilitating lateral movement of said mattress support panel to return said mattress to said frame; and wherein said rollers are selectively disengageable from said tracks such that said support mattress is supported directly on said frame.

* * * * *